US007114985B2

(12) United States Patent
Doorhy et al.

(10) Patent No.: US 7,114,985 B2
(45) **Date of Patent: *Oct. 3, 2006**

(54) LOW CROSSTALK MODULATOR COMMUNICATION CONNECTOR

(75) Inventors: Michael Doorhy, Mokena, IL (US); Andrew J. Stroede, Mokena, IL (US); Russell A. Vanderhoof, Minooka, IL (US)

(73) Assignee: Panduit Corporation, Tinley Park, IL (US)

( * ) Notice: Subject to any disclaimer, the term of this patent is extended or adjusted under 35 U.S.C. 154(b) by 28 days.
This patent is subject to a terminal disclaimer.

(21) Appl. No.: 11/181,990

(22) Filed: Jul. 15, 2005

(65) Prior Publication Data

US 2005/0250372 A1 Nov. 10, 2005

Related U.S. Application Data

(63) Continuation of application No. 10/926,073, filed on Aug. 26, 2004, now Pat. No. 6,923,673, which is a continuation of application No. 10/680,218, filed on Oct. 8, 2003, now Pat. No. 6,799,989, which is a continuation of application No. 10/215,087, filed on Aug. 9, 2002.

(51) Int. Cl.
*H01R 11/20* (2006.01)
*H01R 4/26* (2006.01)
*H01R 4/24* (2006.01)

(52) U.S. Cl. ..... 439/404; 439/941; 439/405
(58) Field of Classification Search ..... 439/404, 439/941, 676, 405
See application file for complete search history.

(56) References Cited

U.S. PATENT DOCUMENTS

| | | | | |
|---|---|---|---|---|
| 3,565,807 | A | 2/1971 | Siverisen et al. | 428/189 |
| 4,153,325 | A | 5/1979 | Asick | 439/405 |
| 4,392,701 | A | 7/1983 | Weidler | 439/76.1 |

(Continued)

FOREIGN PATENT DOCUMENTS

WO WO 97/44862 11/1997

*Primary Examiner*—Javaid H. Nasri
(74) *Attorney, Agent, or Firm*—Oliff & Berridge, PLC

(57) ABSTRACT

A modular communications connector includes a housing defining a plug receiving opening, a conductor carrying sled including a printed circuit board designed in conjunction with the conductors to improve crosstalk performance. The connector includes a wire containment fixture arrangement allows for simplified field termination of the modular connector. The connector is assembled by loading the contacts and printed circuit board onto the sled, which is snap fit into the housing. Then, wires are positioned through the wire containment fixture and the fixture is slidably engaged with the sled at a first position and slid along the sled to a second position where the wires are terminated with IDCs mounted on the sled. The connector preferably includes first and second pluralities of conductors, with the second plurality each having IDC portions arranged in first and second rows of four IDCs. The top and bottom IDC portion at each end of the rows terminates an associated wire pair and the two internal IDC portions of each row terminates an associated wire pair. The connector also preferably includes a printed circuit board that is engageable with both the first and second plurality of conductors. The printed circuit board has at least three layers, with a pair of outer layers containing traces that complete an electrical path between the IDCs of the second plurality of conductors and a corresponding first end portion of the first plurality of conductors. One or more capacitors are provided on an inner layer of the printed circuit board.

10 Claims, 11 Drawing Sheets

U.S. PATENT DOCUMENTS 4,409,608 A 10/1983 Yoder ..... 357/51
4,651,340 A 3/1987 Marson ..... 371/155
4,731,833 A 3/1988 Gumb et al. ..... 379/399
4,756,695 A 7/1988 Lane et al. ..... 439/76
4,767,338 A 8/1988 Dennis et al. ..... 439/55
4,968,260 A 11/1990 Ingalsbe ..... 439/76
4,975,078 A 12/1990 Stroede et al. ..... 439/405
5,055,966 A 10/1991 Smith et al. ..... 361/321
5,069,641 A 12/1991 Sakamoto et al. ..... 439/620
5,091,826 A 2/1992 Arnett et al. ..... 361/776
5,178,554 A 1/1993 Siemon et al. ..... 439/188
5,295,869 A 3/1994 Siemon et al. ..... 439/620
5,299,956 A 4/1994 Brownell et al. ..... 439/638
5,326,284 A 7/1994 Bohbot et al. ..... 439/676
5,399,106 A 3/1995 Ferry ..... 439/620
5,414,393 A 5/1995 Rose et al. ..... 333/1
5,431,584 A 7/1995 Ferry ..... 439/620
5,432,484 A 7/1995 Klas et al. ..... 333/1
5,435,752 A 7/1995 Siemon et al. ..... 439/620
5,488,201 A 1/1996 Liu ..... 174/262
5,513,065 A 4/1996 Caveney et al. ..... 361/311
5,577,937 A 11/1996 Itoh et al. ..... 439/620
5,586,914 A 12/1996 Foster, Jr. et al. ..... 439/676
5,636,099 A 6/1997 Sugawara et al. ..... 361/278
5,679,027 A 10/1997 Smith ..... 439/676
5,700,167 A 12/1997 Pharney et al. ..... 439/676
5,716,237 A 2/1998 Conorich et al. ..... 439/660
5,885,111 A 3/1999 Yu ..... 439/676
6,102,741 A 8/2000 Boutros et al. ..... 439/676
6,183,306 B1 2/2001 Caveney ..... 439/676

LOW CROSSTALK MODULATOR COMMUNICATION CONNECTOR

This is a Continuation of application Ser. No. 10/926,073, filed Aug. 26, 2004, now U.S. Pat. No. 6,923,673, which in turn is a Continuation of application Ser. No. 10/680,218 filed Oct. 8, 2003, now U.S. Pat. No. 6,799,989, which in turn is a Continuation of application Ser. No. 10/215,087 filed Aug. 9, 2002, now U.S. Pat. No. Re. 38,519, which in turn is a Reissue of U.S. Pat. No. 6,371,793 B1 issued Apr. 16, 2002 (application Ser. No. 09/138,969 filed Aug. 24, 1998). The entire disclosure of the prior applications is hereby incorporated by reference herein in its entirety.

BACKGROUND OF THE INVENTION

1. Field of Invention

The present invention relates to modular communication connectors and more particularly to a modular communication connector that utilizes a printed circuit board design and conductor arrangement to provide for improved crosstalk performance and also provides for simplified wire termination.

2. Description of Related Art

Standard telephone jack connectors and other modular connectors of generally similar design are well known in the communications industry. However, along with the constantly increasing signal transmission rates exists the need for modular communication connectors to have improved crosstalk performance. It is also important for these connectors to continue to have simple field termination capability. Thus, increasing performance requirements for communication connectors establish a need in the art of modular communication connectors to be economically manufactured which can be easily field terminated and that will achieve higher levels of suppressing crosstalk interference.

SUMMARY OF THE INVENTION

It is an object of the present invention to provide a modular communication connector with improved crosstalk performance.

It is another object of the present invention to provide a modular communication connector with simplified field terminability.

In general, a modular communications connector, includes a housing defining a plug receiving opening, a conductor carrying sled supporting a plurality of conductors each including an insulation displacement contact (IDC) portion disposed extending rearwardly in a direction generally parallel to an axis of entry of the plug receiving opening; and a wire containment fixture having means for positioning wires with respect to the IDC portions, said fixture being engageable to and slidably movable along a portion of the conductor carrying sled. The connector also utilizes a printed circuit board design incorporating capacitors which in conjunction with the conductor design improves the overall crosstalk performance. The IDC portions of the conductors are arranged in upper and lower rows of four IDC portions each such that the top and bottom IDC portion at each end of the rows terminates a wire pair and the two internal IDC portions of each row terminates a wire pair and the printed circuit board includes at least three layers with the outer layers containing a plurality of traces for interconnecting the first and second plurality of conductors, and formed on an inner layer of the PCB for affecting the crosstalk performance of the connector.

DETAILED DESCRIPTION OF PREFERRED EMBODIMENTS

Figure 1:
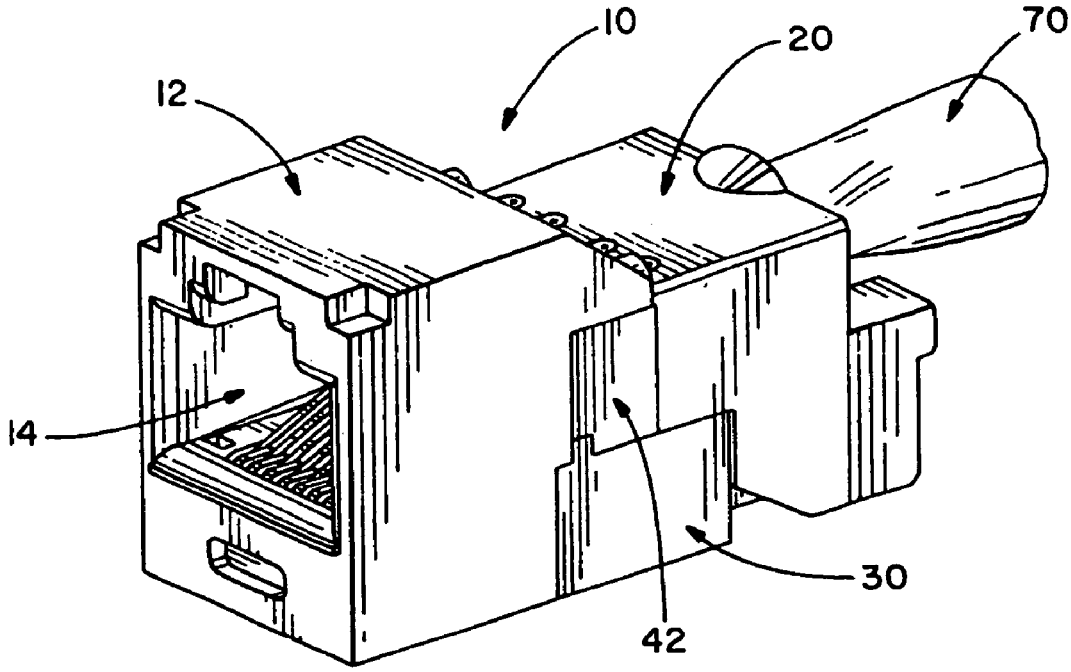
FIG. 1 is a front perspective view of a free standing modular communication connector embodying the concept of the present invention.
Figure 2:
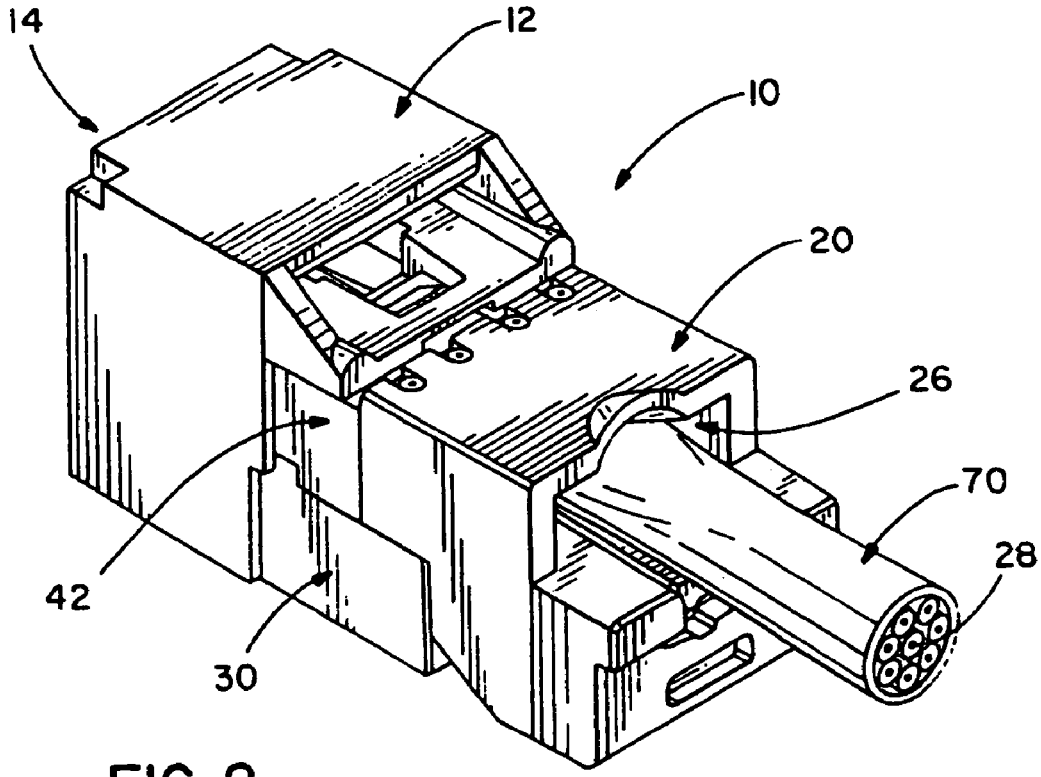
FIG. 2 is a rear perspective view of the connector of FIG. 1.
Figure 3:
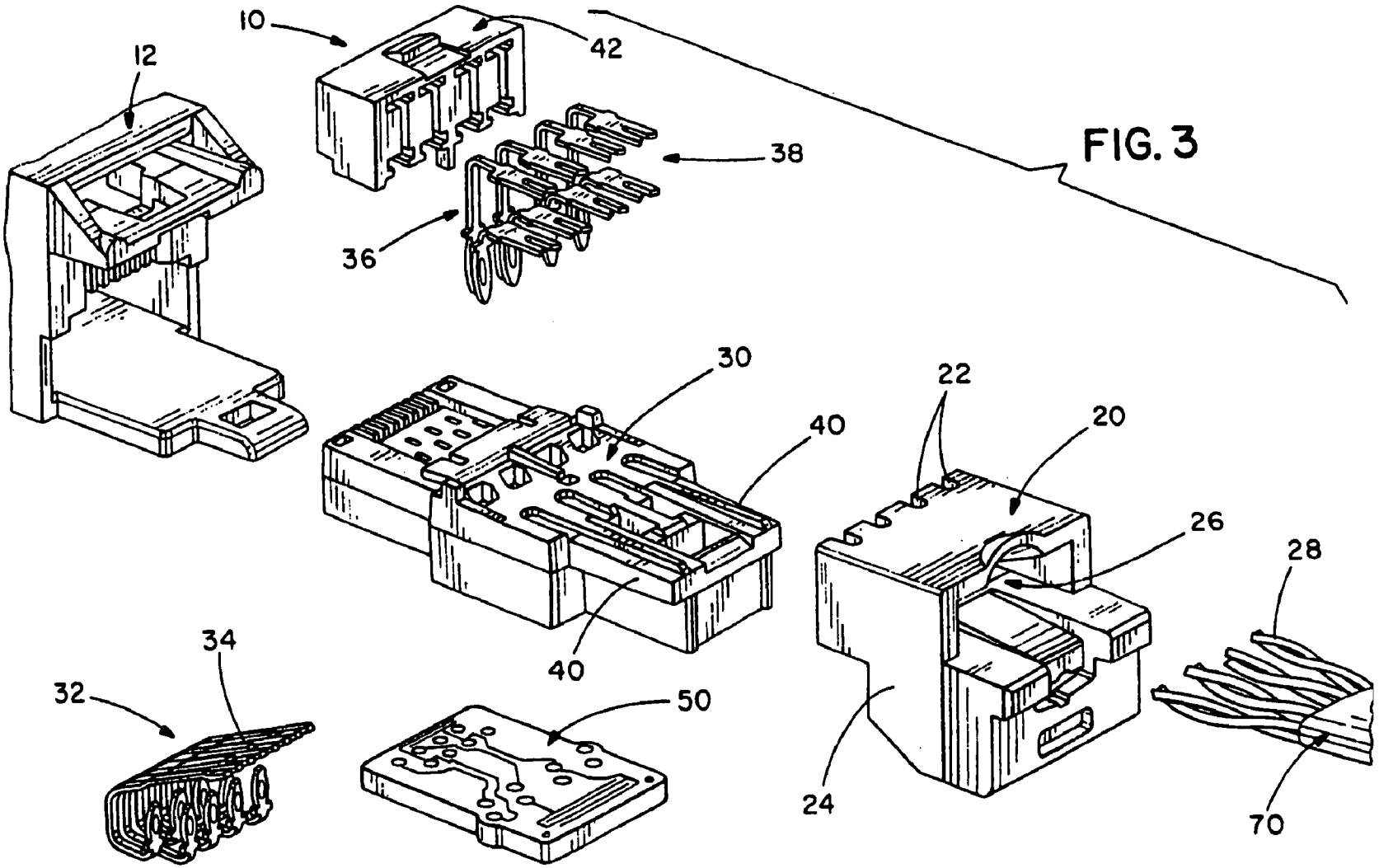
FIG. 3 is a rear perspective exploded view of the connector of FIG. 1.
Figure 4:
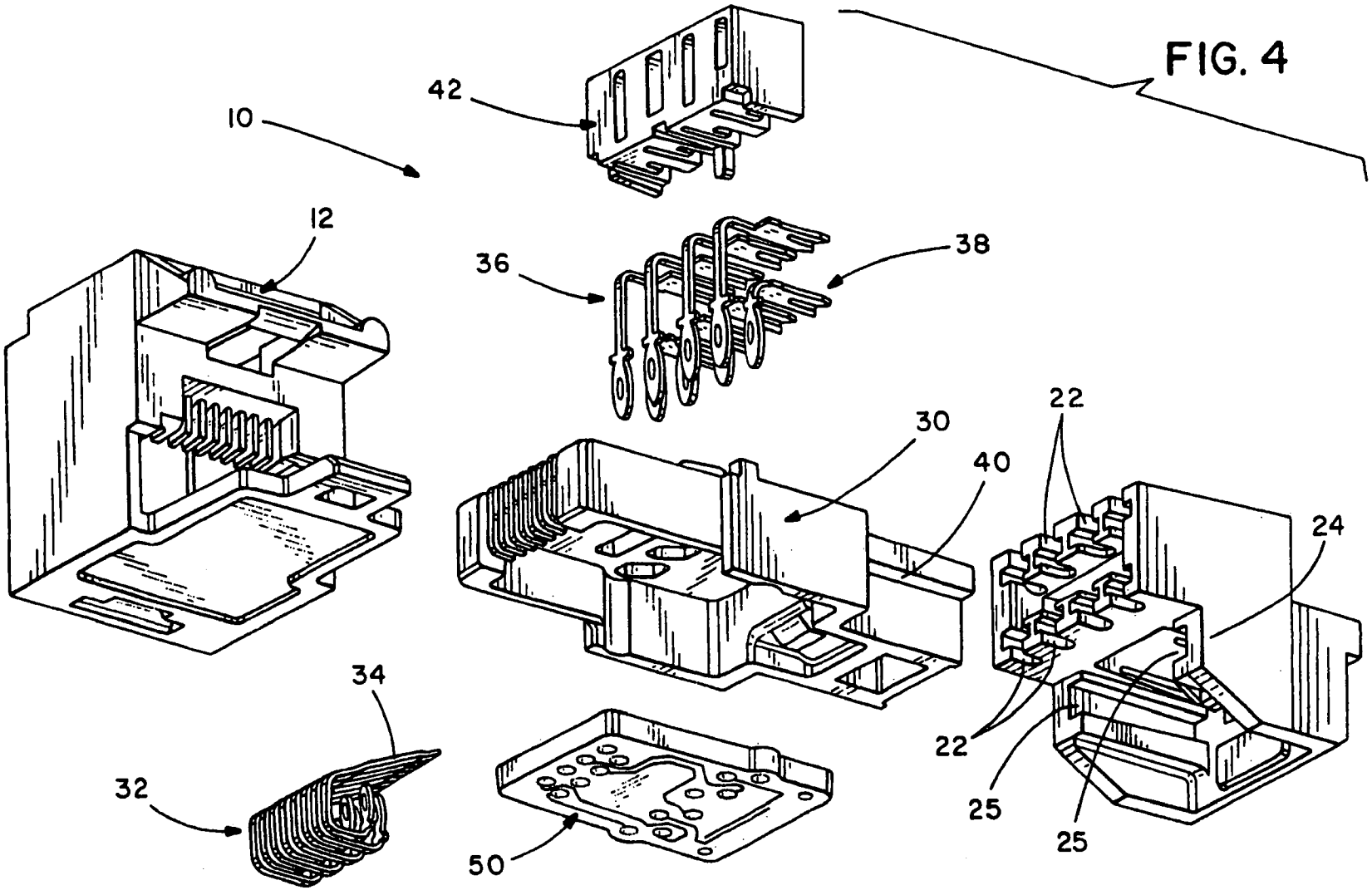
FIG. 4 is a bottom perspective exploded view of the connector of FIG. 1.
Figure 5:
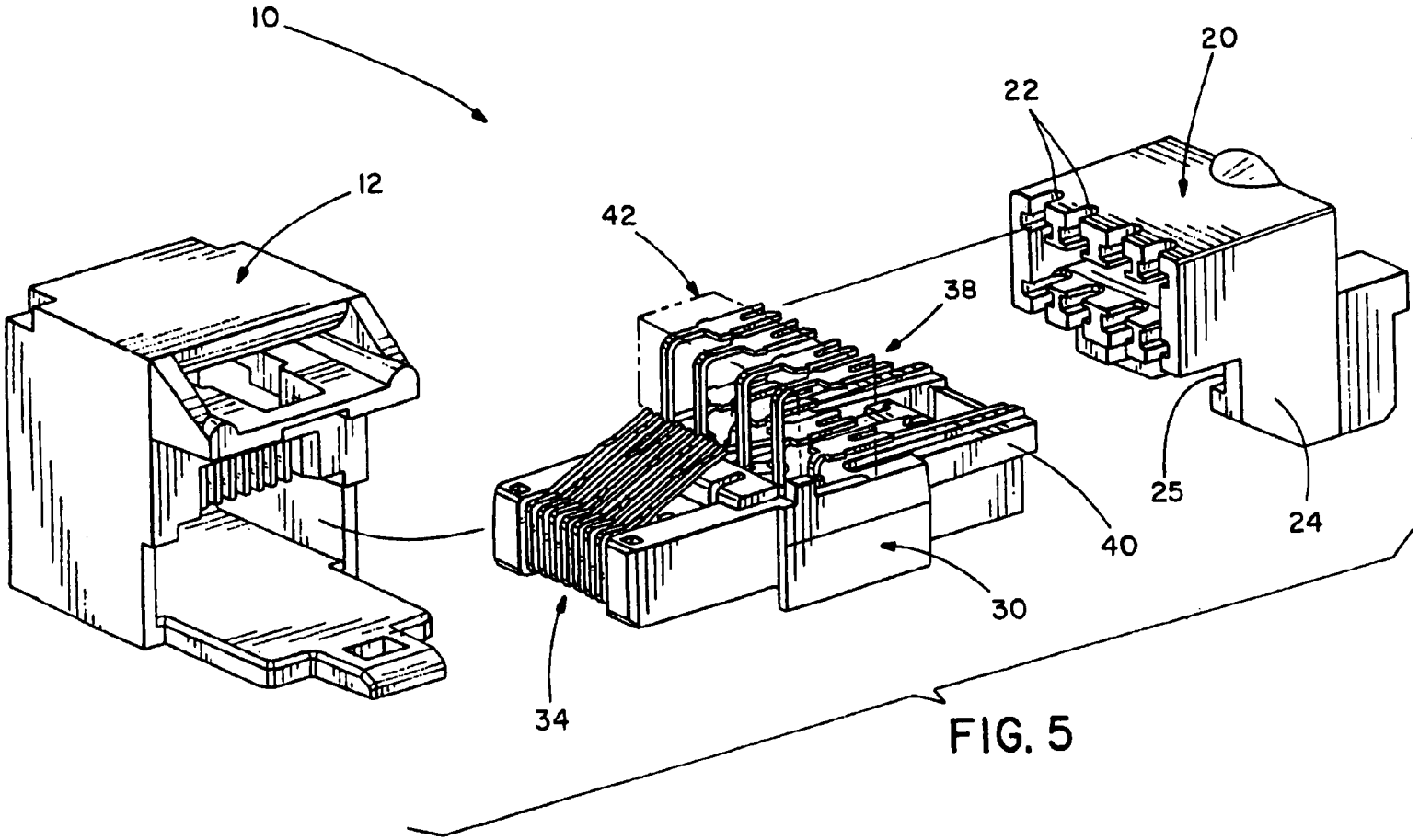
FIG. 5 is a subassembly view of the connector of FIG. 1 showing the sled prior to engagement with the housing.

A modular communication connector embodying the concept of the present invention is designated generally by the reference numeral 10 in the accompanying drawings. As shown in FIGS. 1 and 2, connector 10 includes a housing 12 defining a plug receiving opening 14, a conductor carrying sled 30 and a wire containment fixture 20 for terminating a communication cable 70 having a plurality of individual communication wires 28.

Figure 8:
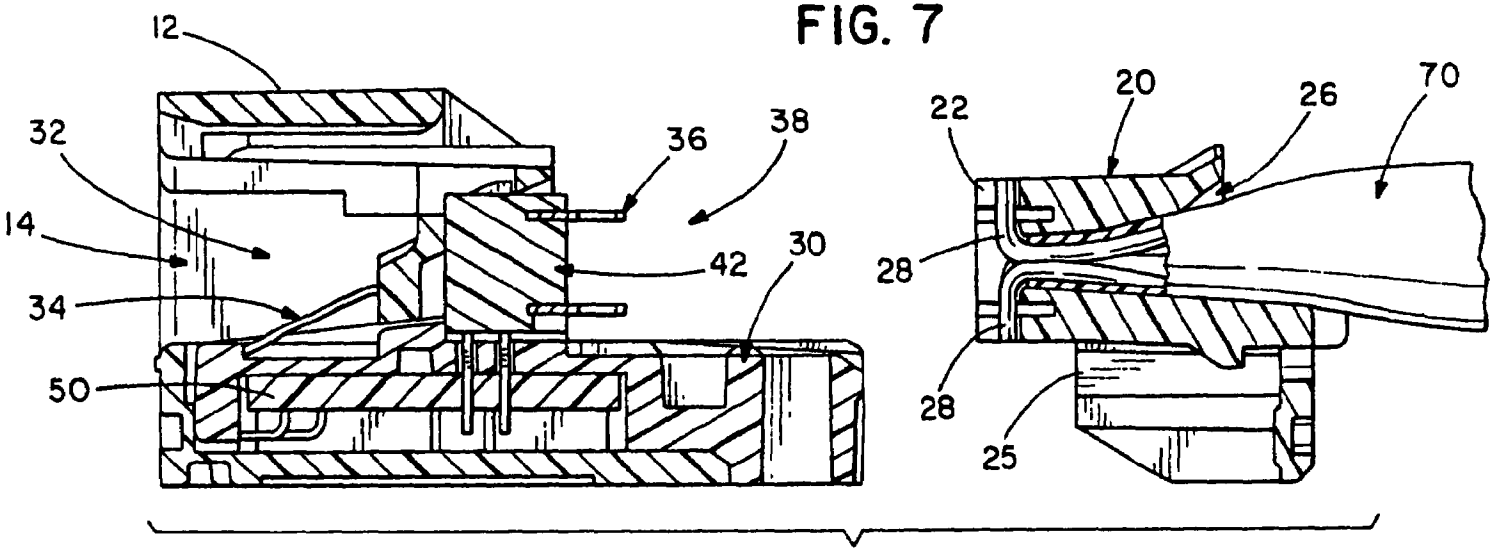
FIG. 8 is a sectional view taken along line 8—8 of FIG. 7.
Figure 9:
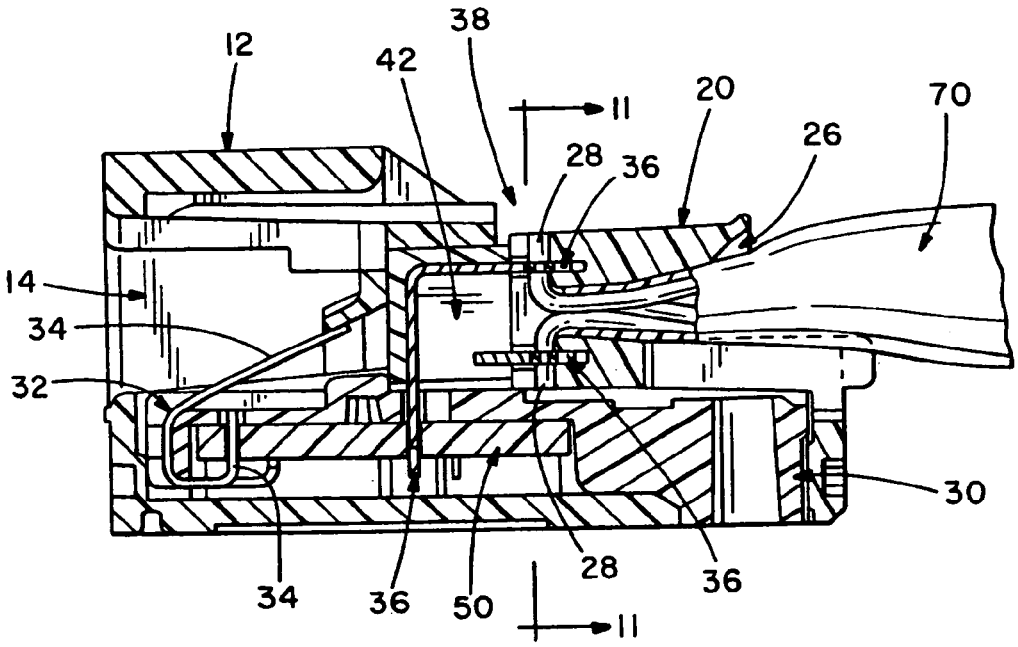
FIG. 9 is a sectional view taken along line 9—9 of FIG. 7.
Figure 10:
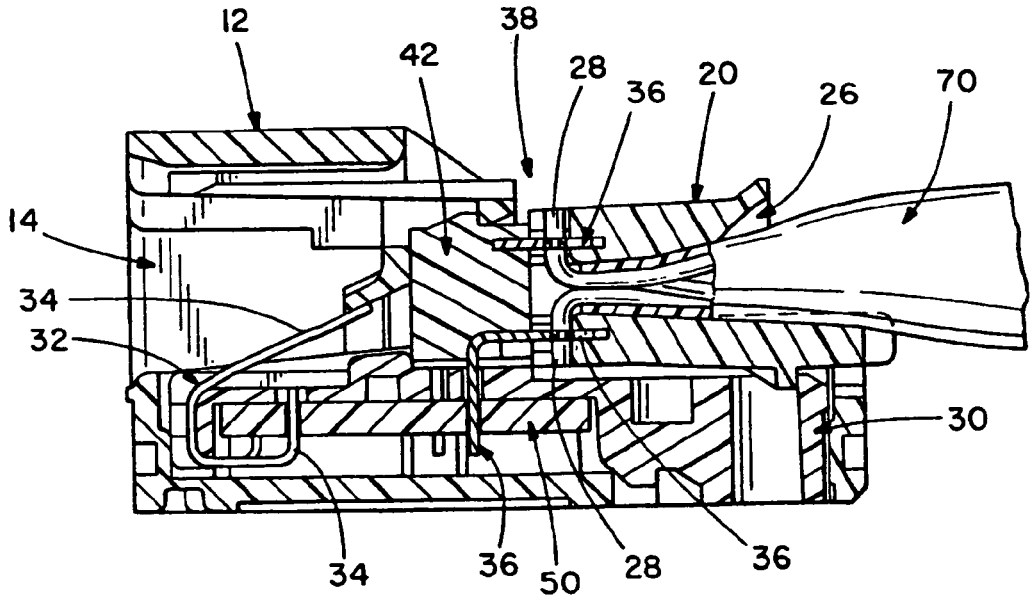
FIG. 10 is a sectional view taken along lines 10—10 of FIG. 7.
Figure 11:
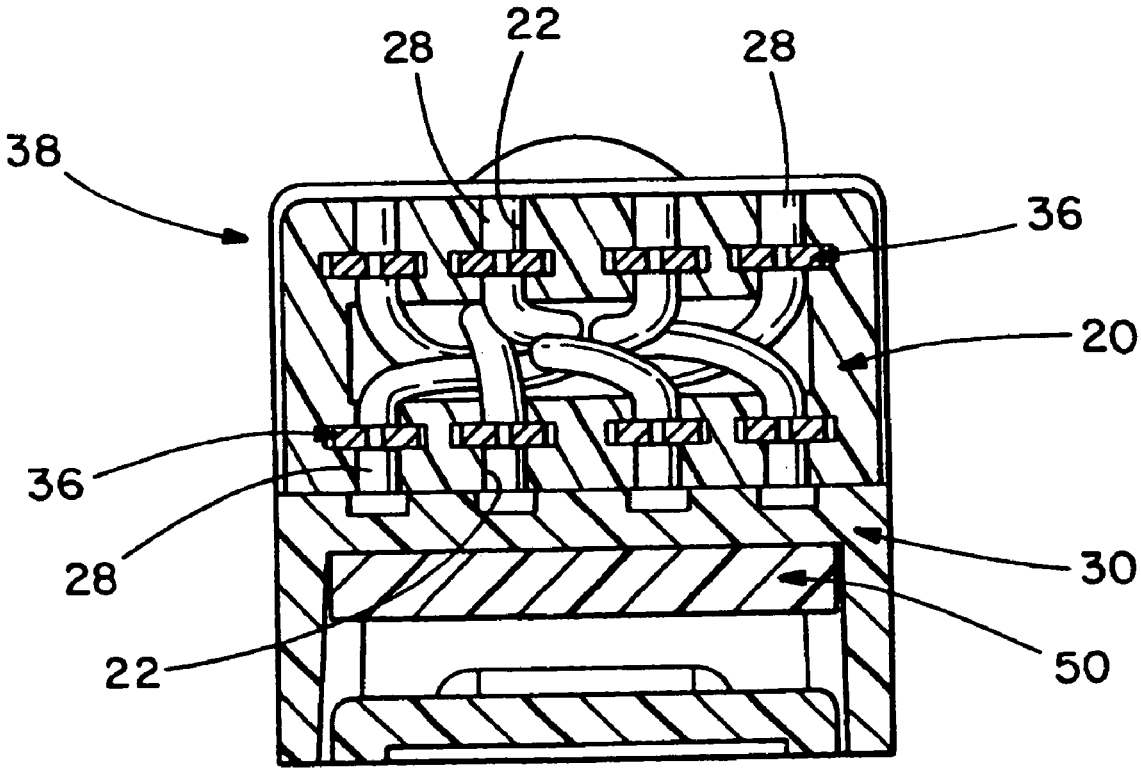
FIG. 11 is a sectional view taken along lines 11—11 of FIG. 9.
Figure 12:
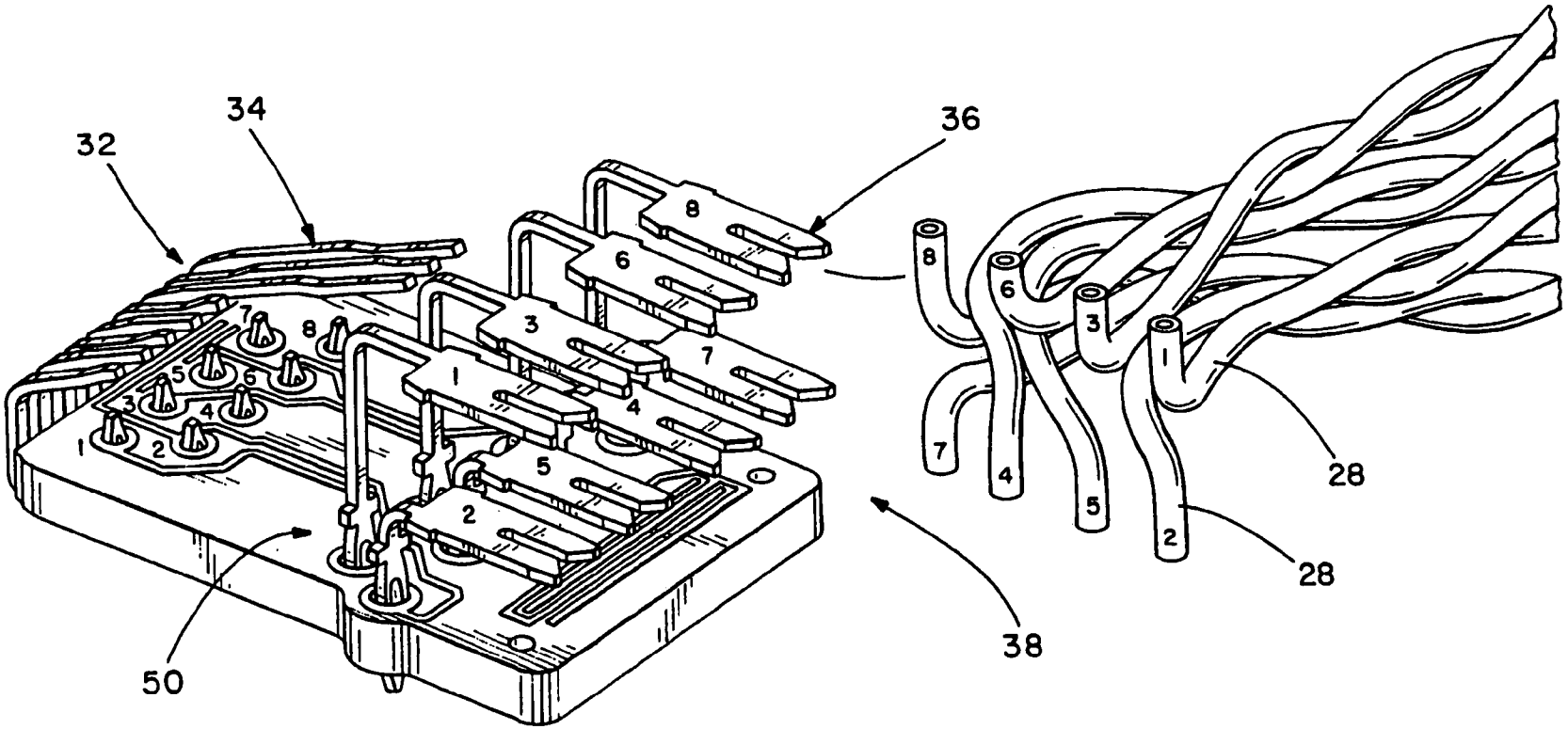
FIG. 12 is a perspective view of the twisted wire pairs shown without the wire containment fixture and the contact arrangement of the PCB shown without the housing, sled and IDC block.
Figure 15:
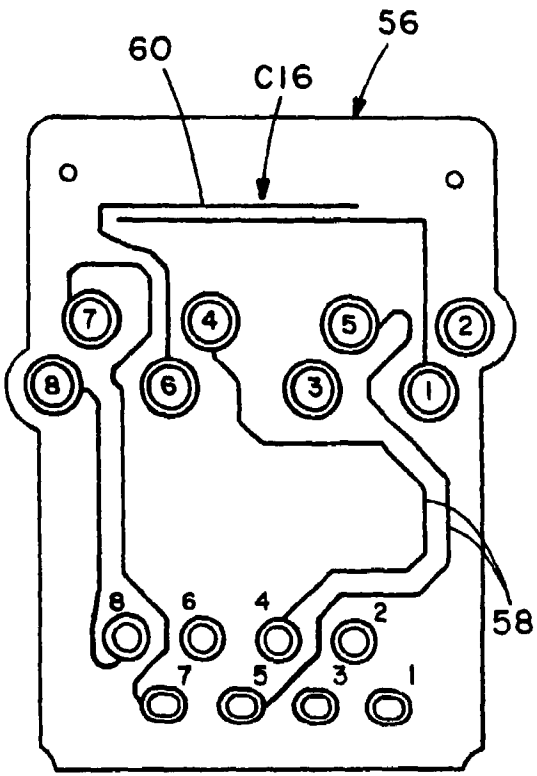
FIG. 15 is a plan view of the bottom layer of the printed circuit board.
Figure 14:
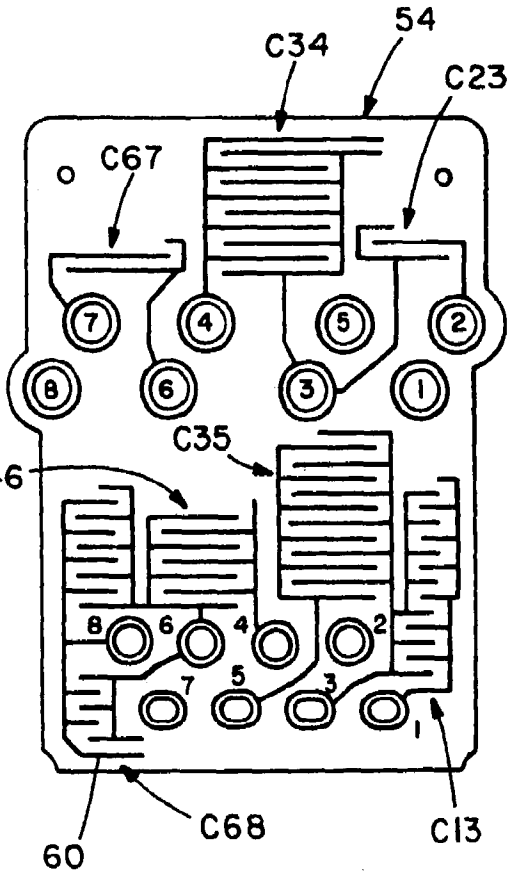
FIG. 14 is a plan view of the second layer which is identical to the third layer of the printed circuit board.
Figure 13:
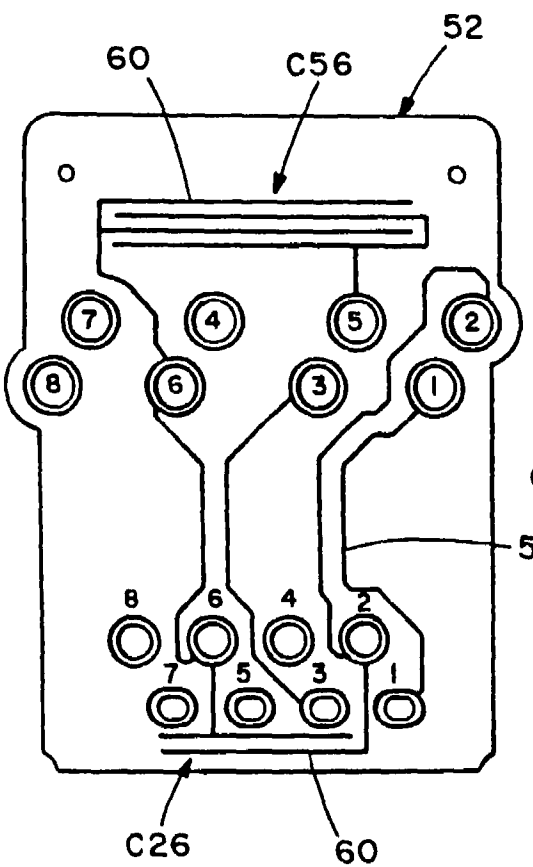
FIG. 13 is a plan view of the top layer of the circuit board.
Figure 16:
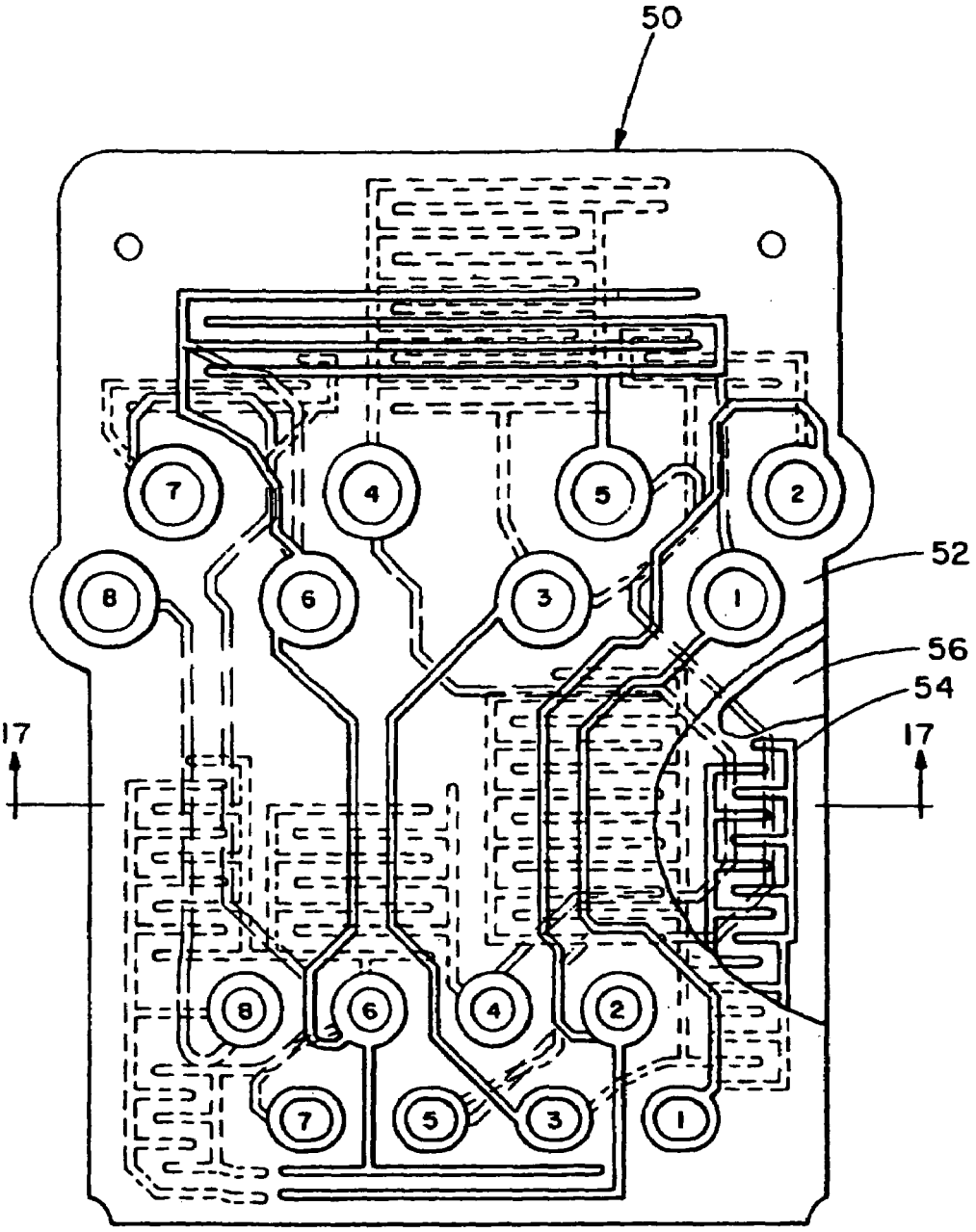
FIG. 16 is a plan view of the PCB with portions broken away to see the lower layers.
Figure 17:
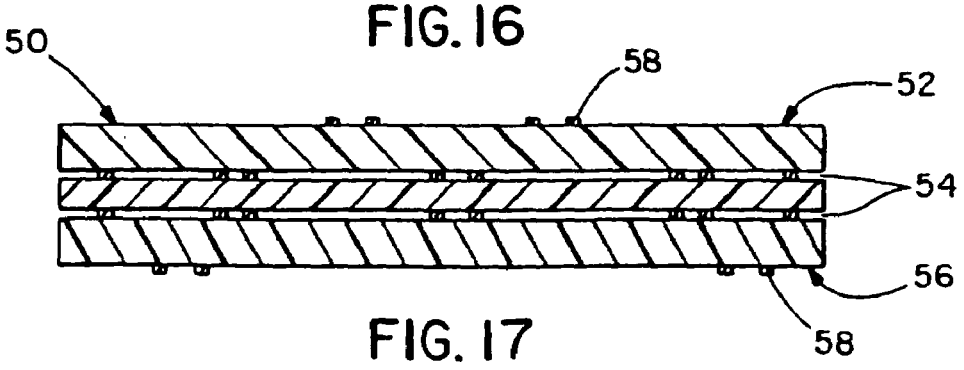
FIG. 17 is a sectional view of the printed circuit board taken along lines 17—17 of FIG. 16.

As can be seen in FIGS. 3–6, connector 10 includes a conductor carrying sled 30 that supports a printed circuit board (PCB) 50 and a first and second plurality of conductors. The first plurality of conductors 32 each have a resilient contact portion 34 at a first end which is to be disposed within the plug receiving opening in accordance with a standard telephone plug mating configuration. The standards for the connector interface provides for eight laterally spaced conductors numbered 1–8, wherein the conductor pairs are defined by the associated wire pairs in accordance with the standard. Specifically, the standard pair arrangement provides for wires 4 and 5 comprising pair 1, wires 3 and 6 comprising pair 2, wires 1 and 2 comprising pair 3, and wires 7 and 8 comprising pair 4. As shown in FIGS. 8 and 12, each of the conductors 32 also includes a compliant pin at the second end so that the conductors 32 can be secured to the PCB 50 without requiring soldering.

Figure 6:
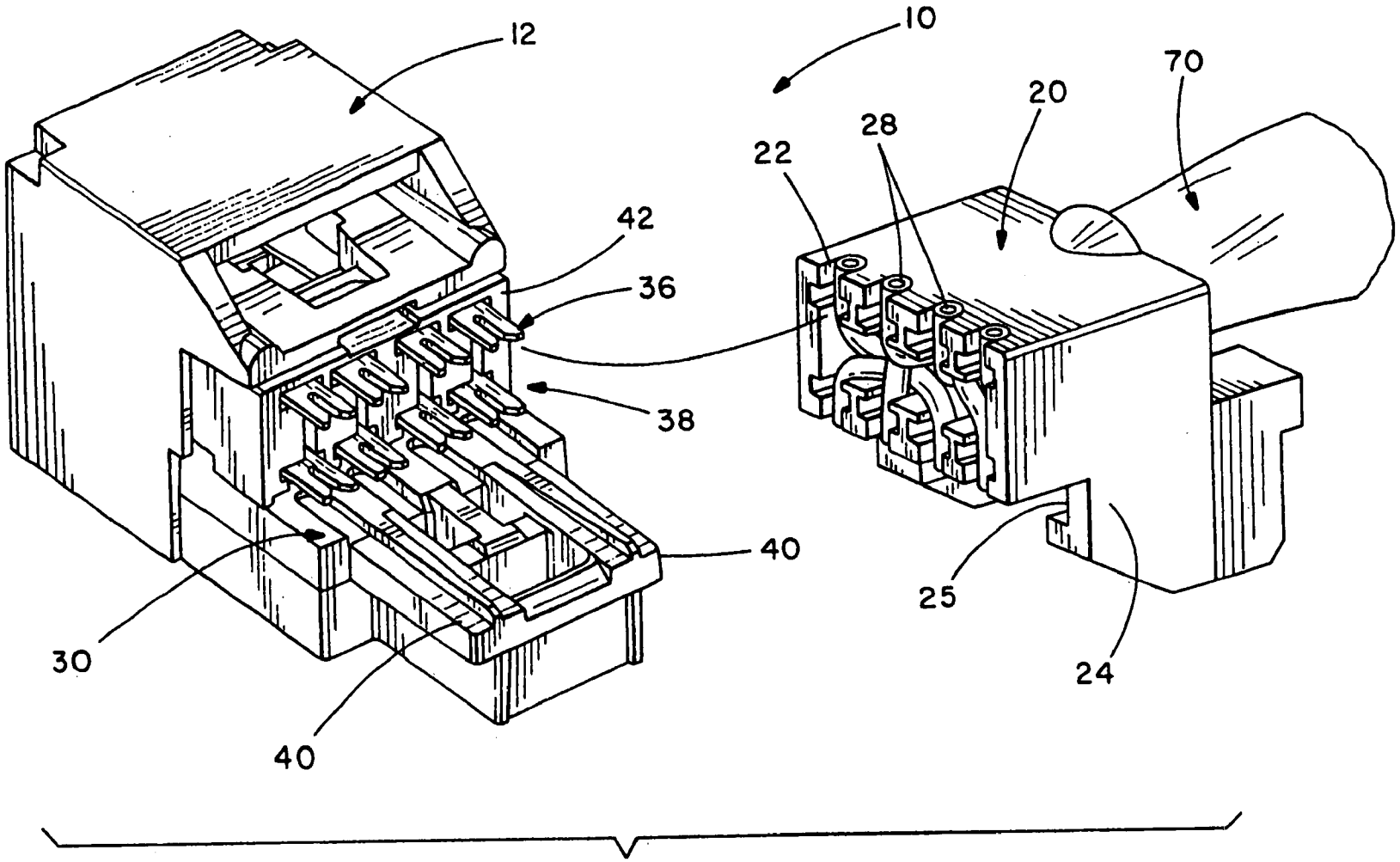
FIG. 6 is a subassembly view of the connector of FIG. 1 shown prior to termination by the wire containment fixture.
Figure 7:
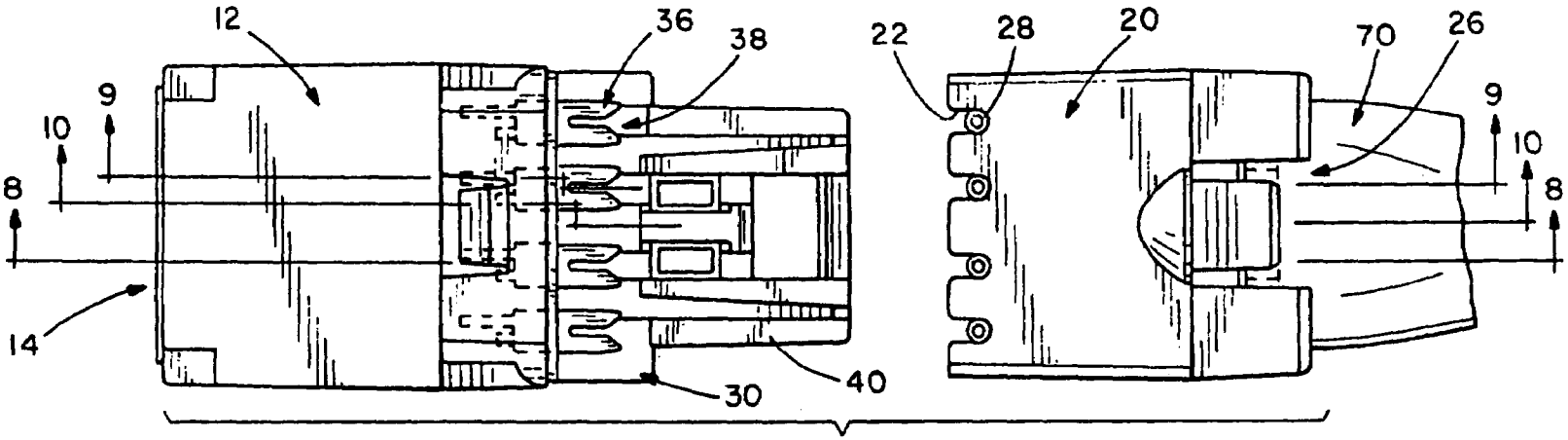
FIG. 7 is a top view of the connector of FIG. 1 shown prior to termination by the wire containment fixture.

The second plurality of conductors 36 each includes a compliant pin at one end for engagement with the PCB 50 and an IDC portion 38 at the second end. The second plurality of conductors 36 are configured such that the IDC portions 38 are disposed extending rearwardly in a direction generally parallel to an axis of entry of the plug receiving opening 14. The axis of entry is the generally horizontal direction in which a standard telephone plug type connector would be inserted in order to mate with the resilient contacts of the connector. The second plurality of conductors are initially loaded into an IDC block 42 which is used to aid in the manufacturing and assembly process. The IDC block 42 has locating pockets and a peg for accurate positioning on the sled 30. After assembling the PCB 50 and conductors 32, 36 in position on sled 30, the sled is inserted into the rear end of the housing such that resilient contact portions 34 of the first plurality of conductors 32 are disposed within the plug receiving opening 14 of housing 12 and the IDC portions 38 extend horizontally away from the back end in position for termination of the individual wires 28 as shown in FIG. 6. Latches on the housing secure the sled in position.

As can be seen in FIGS. 3, 4, 6 and 8, the wire containment fixture 20 has a cable opening 26 that allows both flat and round cable to be loaded into the wire containment fixture. The front end of wire containment fixture 20 includes eight individual vertically aligned wire slots 22. Thus as the twisted pair conductors of the cable are brought through the opening, the individual wires can be routed into their respective wire slots 22. A label indicating the wiring scheme can be placed on the wire containment fixture 20 for providing the user instructions. Engagement walls 24 including guide slots 25 are provided on fixture 20 beneath the wire slots 22 and are formed to engage with a pair of guide rails 40 disposed on each lateral edge of the rearward end of sled 30 to allow for sliding movement of fixture 20 along sled 30 and to provide for proper wire location during termination.

In general, in communications connectors, some crosstalk effect is occurring at every portion along adjacent conductors of the connector. That is, crosstalk occurs between adjacent conductors at the resilient contact portions of the plug mating end, between adjacent contacts on the PCB, as well as between adjacent IDC portions. It is in the preferred embodiment shown that the overall crosstalk performance of the connector is enhanced through a combination of minimizing crosstalk interaction between adjacent conductors where possible and utilizing capacitors on a unique PCB design to balance the overall crosstalk effect.

As can be seen in FIGS. 13–16, the printed circuit board 50 is a four layer board with a plurality of through holes formed through all four layers, each of which corresponds respectively with one of the compliant pin ends of one of the first or second plurality of conductors 32, 36. The top 52 and bottom 56 outer layers contain the traces 58 for interconnecting the first and second plurality of conductors 32, 36 via their respective conductive through holes. The two inner layers 54 are identical to each other and is shown only once in FIG. 14. Seven of the ten capacitors 60 which are utilized in the proposed design for crosstalk reduction are housed in the middle two layers 54. The outer layers 52, 56 also include three capacitors 60 which in the preferred design were not placed in the middle layers 54 due to space and capacitor layout constraints.

As can be seen, the conductor traces 58 within a pair are of relatively the same length and run nearby each other to obtain a proper impedance for return/loss performance and to reduce possible far end crosstalk (FEXT) effect. It is to be noted that the thickness of the traces can also be adjusted to achieve the required impedance. Additionally, certain contact pairs have the traces 58 run on opposite sides of the board to minimize is near end crosstalk (NEXT) in that area. For example, traces 4 and 5, and 7 and 8 for pairs 1 and 4 respectively are disposed on the bottom board, whereas traces 3 and 6, and 1 and 2 for pairs 2 and 3 respectively are disposed on the top board.

Capacitance is added to the PCB in order to compensate for the crosstalk which occurs between adjacent conductors of different pairs throughout the connector arrangement. The capacitance can be added in several ways. The capacitance can be added as chips to the board or can be integrated into the board using pads or finger capacitors.

In the preferred embodiment shown, capacitors are added in the form of finger or interdigitated capacitors connected to conductor pairs. The capacitors are identified by the conductor to which they are connected and to which capacitance is added to balance the crosstalk effect seen by the other conductor of a pair. For example, C46 identifies the finger capacitor connected to conductors 4 and 6 to balance the crosstalk seen between conductors 4 and 6 with the crosstalk seen between conductors 5 and 6 throughout the connector.

As can best be seen in FIG. 12, the IDC portions 38 for terminating pairs of wires of the communication cable are arranged in two rows of four IDC portions. The contacts are configured such that the top and bottom IDC portion at each end of the rows terminates a wire pair and the two internal IDC portions of each row terminate a wire pair. Specifically, as previously discussed the standard pair arrangement is wires 4 and 5 are pair 1, wires 3 and 6 are pair 2, wires 1 and 2 are pair 3 and wires 7 and 8 are pair 4. The standard in the industry sets forth that the odd wires are the tip and the even wires are the ring of the pair. As best seen in FIG. 12, pair 3 comprising contacts 1 and 2 and pair 4 comprising contacts 7 and 8 are disposed respectively at the left and right ends of the two rows of IDC portions. Pair 2 comprising contacts 3 and 6 is disposed on the upper row at the two internal IDC portions and pair 1 comprising contacts 4 and 5 is disposed in the bottom row within the two inner IDC portions. This specific IDC arrangement improves crosstalk performance by minimizing any additional undesired crosstalk while helping to balance existing crosstalk effects found in the standard plug and jack contact arrangement. Furthermore, this IDC layout allows for pairs to remain twisted as close to the IDC's as possible which helps decrease the crosstalk needed to be balanced in the connector. Thus, the IDC arrangement allows for a simplified PCB capacitor design.

In the field, the preassembled housing 12 and sled 30 containing the printed circuit board 50, first plurality of contacts 32, second plurality of contacts 36 and IDC block 42 is provided such that the plug mating resilient contact portions 34 are disposed within the plug receiving opening 14 and the IDC portions 38 are horizontally disposed for accepting the individual wires 28. The communication cable 70 is inserted into the opening 26 of the wire containment fixture 20, the individual wires 28 are inserted into the respective wire slots 22 and the excess wire cut off. Finally, the wire containment 20 having the engagement walls 24 with guide slots 25 is assembled onto sled 30 via the guide rails 40 and slid forward until proper termination is achieved and locked in position by a cantilevered snap latch.

While the particular preferred embodiments of the present invention have been shown and described, it will be obvious to those skilled in the art that changes and modifications may be made without departing from the teachings of our invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical connector for use with one of a plug and a jack as well as a cable that includes a cable jacket that covers a first portion of multiple pairs of wires, a second portion of the multiple pairs of wires extending beyond the cable jacket, the first portion and the second portion meeting at a junction, the electrical connector comprising:

a housing assembly that is engageable with the one of the plug and the jack, the housing assembly including a plurality of connectors that each include an IDC portion; and a wire containment fixture including a contiguous body defining a pair of exterior walls and an opening that includes an entry end that receives the cable and an exit end, the body further defining a plurality of wire slots, each of the plurality of wire slots extending from the exit end of the opening and through one of the exterior walls to enable one wire of the second portion of one of the multiple pairs of wires to terminate therein, the opening being convergent in a direction from the entry end to the exit end, the opening also being configured to enable the second portion of each of the multiple pairs of wires to extend from the junction toward the exit end and to bend in a direction substantially normal to an axis of the opening to terminate in the respective wire slots, the wire containment fixture being engageable with the housing assembly such that the IDC portion of each of the plurality of connectors electrically engages one of the wires terminated in one of the plurality of wire slots.

2. The electrical connector according to claim 1, the exterior walls being substantially planar to facilitate removal of excess wire extending beyond the exterior walls.

3. The electrical connector according to claim 1, each of the wire slots defining an axis that is normal to an axis of the opening.

4. The electrical connector according to claim 1, the exterior walls being substantially parallel.

5. The electrical connector according to claim 1, each of the wire slots defining an axis, all of the axes being parallel.

6. The electrical connector according to claim 1, the plurality of wire slots including eight wire slots, one set of four of the eight wire slots extending through one of the pair of exterior walls, and another set of four of the eight wire slots extending through the other of the pair of exterior walls.

7. The electrical connector according to claim 6, each wire slot of the one set of four wire slots having an axis that is substantially aligned with an axis of one wire slot of the other set of four wire slots.

8. The electrical connector according to claim 7, wire slots having axes which are substantially aligned being disposed such that one pair of wires that terminate therein are of a substantially equal length.

9. The electrical connector according to claim 1, at least a portion of the entry end of the opening of the body being arcuate to facilitate insertion of the first portion of the cable.

10. The electrical connector according to claim 1, all of the wire slots being contiguous with the opening of the body.

* * * * *

UNITED STATES PATENT AND TRADEMARK OFFICE

CERTIFICATE OF CORRECTION

PATENT NO. : 7,114,985 B2
APPLICATION NO. : 11/181990
DATED : October 3, 2006
INVENTOR(S) : Michael Doorhy, Andrew J. Stroede and Russell A. Vanderhoof It is certified that error appears in the above-identified patent and that said Letters Patent is hereby corrected as shown below:

Item (63) on the cover page should read -- Continuation of application No. 10/926,073, filed on Aug. 26, 2004, now Pat. No. 6,923,673, which is a continuation of application No. 10/680,218, filed on Oct. 8, 2003, now Pat. No. 6,799,989, which is a continuation of applicaiton No. 10/215,087, filed on Aug. 9, 2002, now U.S. Pat. No. Re. 38,519, which in turn is a Reissue of U.S. Pat. No. 6,371,793 B1 issued Apr. 16, 2002 (application Ser. No. 09/138,969 filed Aug. 24, 1998). --

Signed and Sealed this

Ninth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,114,985 B2
APPLICATION NO. : 11/181990
DATED : October 3, 2006
INVENTOR(S) : Michael Doorhy et al.

It is certified that error appears in the above-identified patent and that said Letters Patent is hereby corrected as shown below:

On the Title, Page (54)

- (54) Title & Col.1 Title: The word "Modulator" should read "Modular";

- Column 4, Line 4, the word "is" should be omitted after "minimize".

Signed and Sealed this

Twenty-first Day of April, 2009

JOHN DOLL
*Acting Director of the United States Patent and Trademark Office*